US007347302B2

(12) United States Patent
Estacio

(10) Patent No.: US 7,347,302 B2
(45) Date of Patent: Mar. 25, 2008

(54) METHOD AND APPARATUS FOR INSERTING AN ADAPTOR IN A HOUSING

(75) Inventor: Edgardo Y. Estacio, Itasca, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 481 days.

(21) Appl. No.: 10/389,845

(22) Filed: Mar. 17, 2003

(65) Prior Publication Data

US 2004/0182649 A1 Sep. 23, 2004

(51) Int. Cl.
*F16N 11/00* (2006.01)

(52) U.S. Cl. ..... 184/92; 215/336

(58) Field of Classification Search ..... 184/88.1–95; 215/43, 321, 331, 336; 220/293, 296
See application file for complete search history.

(56) References Cited

U.S. PATENT DOCUMENTS 1,775,318 A * 9/1930 Morgan ..... 70/173
1,786,721 A * 12/1930 Reid ..... 220/293
2,801,767 A * 8/1957 Mariani ..... 220/86.2
3,844,437 A * 10/1974 O'Connor ..... 215/208
4,020,970 A * 5/1977 Koscik et al. ..... 220/293
4,267,941 A * 5/1981 Loudin ..... 220/745
4,300,702 A * 11/1981 Scharrer ..... 220/295
4,339,055 A * 7/1982 Hutzenlaub ..... 220/295
4,516,688 A * 5/1985 Freeland ..... 220/293
4,725,354 A * 2/1988 Thomsen et al. ..... 210/232
4,739,861 A * 4/1988 Desjardins ..... 184/1.5
5,662,239 A * 9/1997 Heuvelman ..... 220/506

* cited by examiner

*Primary Examiner*—Chong H Kim
(74) *Attorney, Agent, or Firm*—Jeffrey P. Calfa; Gerald W. Askew

(57) ABSTRACT

An adaptor (100) for insertion into a housing (900) has a gap (105) at least one tab (101) having a stop (401). The housing (900) has an adaptor seat (703), a tang (705) having a stop (707), and at least one slot (709) designed to receive the at least one tab (101). Once the tab (101) is inserted into the slot (709), the adaptor (100) is rotated in the housing (900) such that the adaptor seat (703) rotates in the gap (105). When the stop (707) of the tang (705) meets the stop (401) of the tab (101), the adaptor (100) is prevented from further rotation, thus providing a unique orientation between the adaptor (100) and the housing (900).

7 Claims, 3 Drawing Sheets

METHOD AND APPARATUS FOR INSERTING AN ADAPTOR IN A HOUSING

FIELD OF THE INVENTION

This invention relates to connection of adaptors to housings, including but not limited to connection and orientation of oil fill adaptors to valve covers in internal combustion engines.

BACKGROUND OF THE INVENTION

Compartments that enclose internal combustion engines are often very crowded with limited space and accessibility issues. As a result, an oil fill extension tube may be utilized to provide access to the valve cover so that oil may be added to the engine. The extension tube may be long and oddly shaped to extend the oil entry slot in the valve cover to an accessible point in the engine compartment. The extension tube is often attached to an adaptor that is attached to the valve cover for ease of manufacturing and shipping.

The adaptor may be attached to the valve cover in a number of ways. The adaptor may be welded or brazed to the valve cover, but such a process is prone to leaking and tends to be expensive. The adaptor must be attached to the valve cover when the valve cover is shipped before the manufacturing of the engine, and the valve cover-adaptor combination is bulky to ship. The adaptor and the valve cover may be threaded, but this arrangement does not lend to a singular orientation between the adaptor and the valve cover, which orientation is needed to insure a proper orientation of the oil fill extension tube with respect to the engine. A stamped adaptor allows for only a vertical orientation of the adaptor, which must be short, resulting in limited applicability.

Accordingly, there is a need for a method and apparatus for attaching an adaptor to a valve cover that does not leak, is not expensive to manufacture, is not bulky when shipped, provides a single orientation between the adaptor and the valve cover, and is able to provide any desired orientation between the adaptor and the valve cover.

SUMMARY OF THE INVENTION

A method of inserting an adaptor into an adaptor receiver comprising the steps of inserting a tab of the adaptor into a slot in an adaptor seat of the receiver and rotating the adaptor such that a gap between the tab and a guide of the adaptor slides onto the adaptor seat. When a stop of the tab touches a stop of a tang, the adaptor is no longer rotated.

DESCRIPTION OF A PREFERRED EMBODIMENT

The following describes an apparatus for and method of inserting an adaptor into an adaptor receiver in a housing. The adaptor has at least one tab having a stop and a gap. The adaptor receiver has an adaptor seat, a tang having a stop, and at least one slot designed to receive the at least one tab. Once the tab is inserted into the slot, the adaptor is rotated in the housing such that the gap slides onto the adaptor seat. When the stop of the tang meets the stop of the tab, the adaptor is prevented from further rotation, thus providing a unique orientation between the adaptor and the housing.

Figure 1:
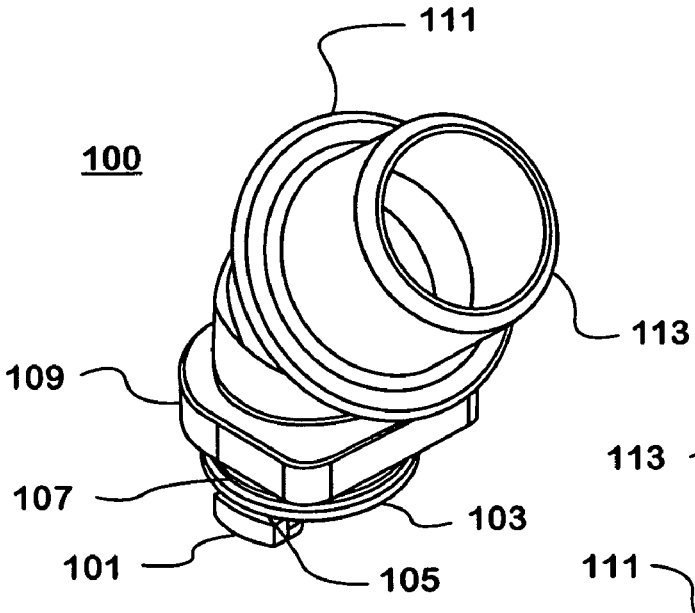
FIG. 1 and FIG. 2 are perspective views of an adaptor in accordance with the invention.
Figure 2:
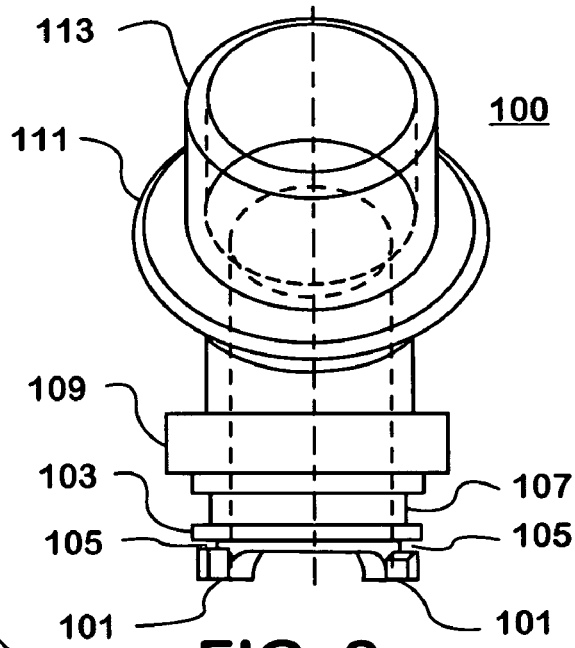
Figure 3:
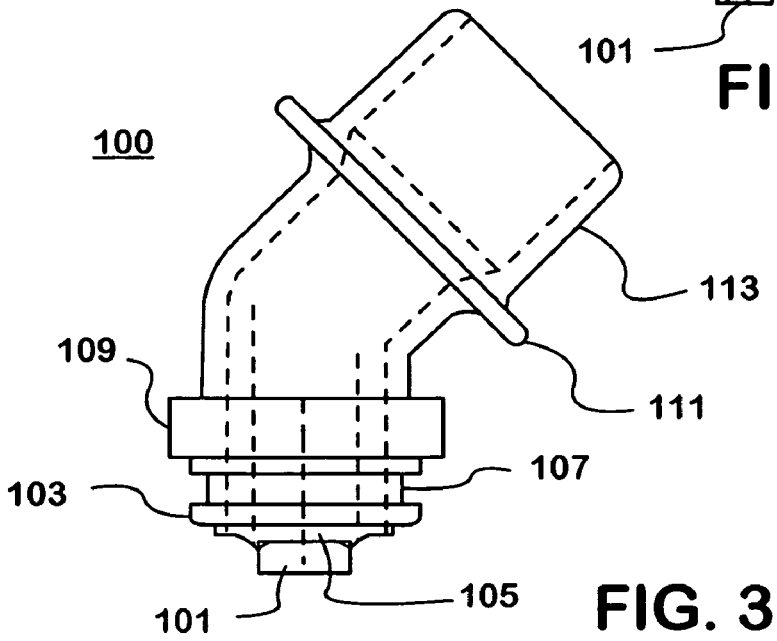
FIG. 3 is a side view of an adaptor in accordance with the invention.

Perspective views of an adaptor 100 are shown in FIG. 1 and FIG. 2. A side view of the adaptor 100 is shown in FIG. 3. The adaptor 100 is built around a hollow section or hollow tube that may have a bend or elbow. Two opposing tabs 101 are at one end of the adaptor 100. Although two tabs 101 are shown, one or more tabs 101 may be utilized successfully. A gap 105 is located between the tabs 101 and a guide 103. As shown in the figures, the gap 105 is planar and extends in a circular manner along the outer perimeter of the adaptor 100. A seal seat 107 is provided for a seal (see 501 in FIG. 5) between the adaptor 100 and its housing 900 (see FIG. 7 through FIG. 9).

A flange 109 provides structural support to the adaptor by preventing the adaptor 100 from being pushed too far into its housing 900 once the adaptor 100 is placed in the housing in its desired orientation. The flange 109 is advantageously larger than the opening in the housing 900 that receives the adaptor 100, thus the flange 109 allows the adaptor 100 to penetrate the housing 900 only a predetermined distance. Preventing the adaptor from being pushed too far into its housing protects the adjacent parts of the adaptor 100 and housing 900. For example, the tabs 101 are prevented from bending or damaging the housing 900. The flange 109 may be keyed to assist in orienting the adaptor 100 to the housing 900. The adaptor 100 further includes a lip 111 and a fitting 113 that receive, for example, an extension tube.

Figure 4:
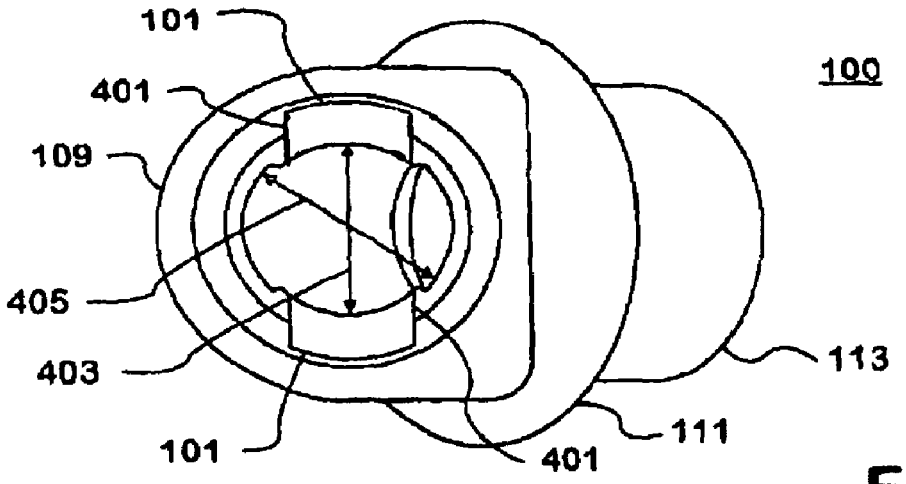
FIG. 4 is a bottom view of an adaptor in accordance with the invention.

A bottom view of an adaptor 100 is shown in FIG. 4. The tabs 101 extend radially outwardly at one end of the adaptor 100. The tabs 101 are shown having the same size and shape, but they may be differently sized and/or shaped in order to key the adaptor 100 to the housing 900, i.e., to provide one possible orientation while inserting the adaptor 100 in the housing 900. Each tab 101 has a stop 401. The stop 401 may advantageously be an edge of the tab, or may comprise another structure. The opening at the bottom of the adaptor 100 is shown with a two opposing partially circular surfaces having a first diameter 403 between the tabs 101 and with a two other opposing partially circular surfaces having a second larger diameter 405. Alternatively, the opening at the bottom of the adaptor 100 may be circular having a single diameter.

Figure 5:
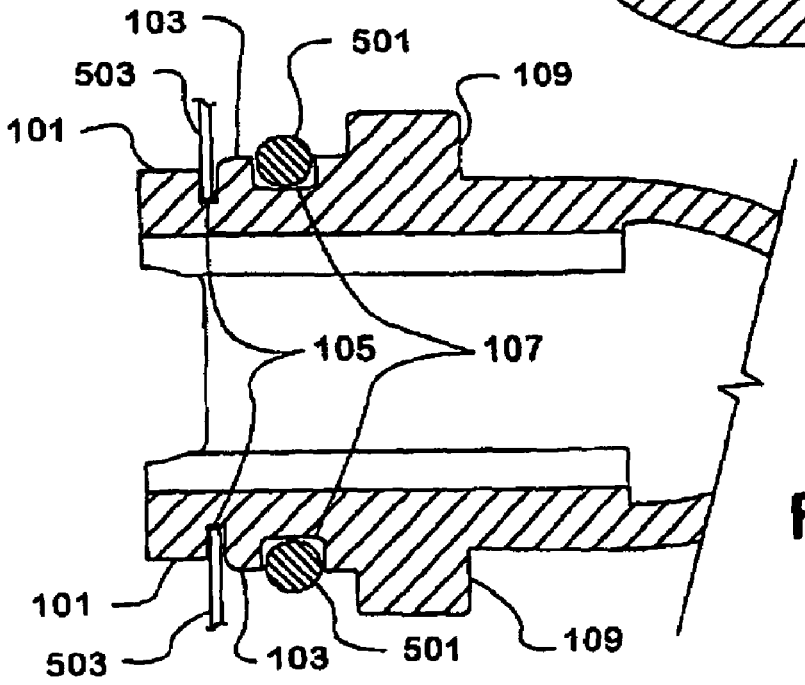
FIG. 5 is a cross-sectional view of an adaptor in accordance with the invention.

A cross-sectional view of the adaptor 100 is shown in FIG. 5. A seal 501 is shown disposed on the seal seat 107. A part 503 of a housing, such as a valve cover, is shown disposed in the gap 105.

Figure 6:
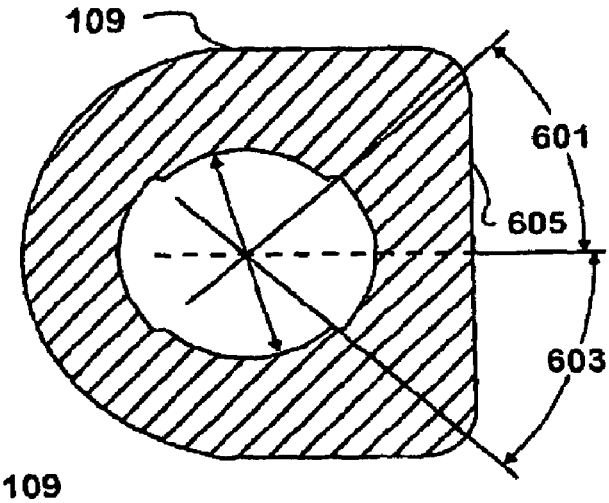
FIG. 6 is a cross-sectional view of a keyed flange of an adaptor in accordance with the invention.

A cross-sectional view of the flange 109 of the adaptor is shown in FIG. 6. The opening in the center of the flange 109 is shown shaped similarly to the opening at the bottom of the adaptor 100 as shown in FIG. 4. Alternatively, the center of the flange 109 may be shaped differently than the opening at the bottom of the adaptor 100. The two opposing partially circular surfaces having a larger diameter may be symmetrical about the center of the flange 109, where the angles 601 and 603 are the same, or the diameters may be different to provide a keyed fitting. The opening at the bottom of the adaptor may be made similar to the opening in the flange 109. The flange 109 has a linear surface 605 that may be utilized to key or match the adaptor 100 to the housing 900.

Figure 7:
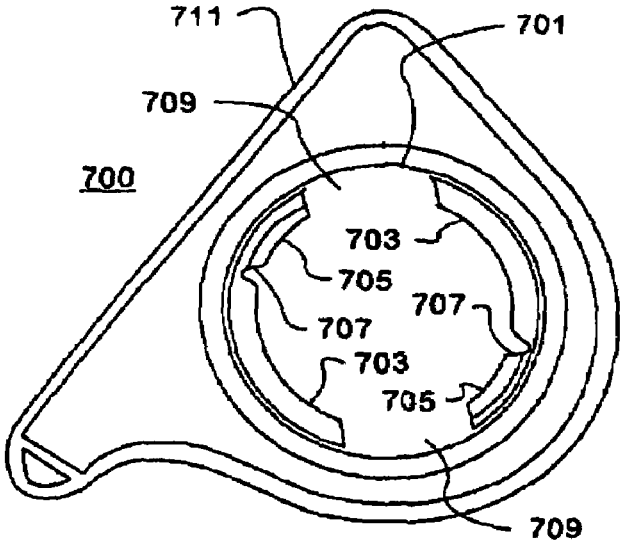
FIG. 7 is a top view of an adaptor receiver for a housing in accordance with the invention.

A top view of an adaptor receiver 700 for a housing is shown in FIG. 7. A recessed plane 701 includes an adaptor seat 703 formed as two sections and a pair of slots 709. The slots 709 are sized and shaped to receive the tabs 101 of the adaptor. The slots 709 may be sized and/or shaped such that the tabs 101 fit in the slots 709 in only one orientation. For example, one of the tabs may be the wrong shape and/or size to fit in one of the slots 709. When keyed in this manner, the adaptor 100 may be inserted into the adaptor receiver 700 in only one orientation. The adaptor receiver 700 has at least as many slots 709 as the adaptor has tabs 101. For example, if there is only one tab 101 on the adaptor 100, the adaptor receiver 700 should have at least one slot 709. When the adaptor receiver 700 has one slot 709, the adaptor seat 703 may be formed in one section. Similarly, when the adaptor receiver 700 has three slots 709, the adaptor seat 703 may be formed in three sections.

Once the tabs 101 of the adaptor 100 are inserted into the slots 709 of the adaptor receiver 700, the adaptor 100 is twisted or rotated in a direction away from the tangs 705, with the gap sliding onto to adaptor seat 703. Advantageously, the adaptor 100 is twisted or rotated less than 180 degrees, thereby making insertion relatively simple and quick. In the embodiment shown in the figures, the adaptor 100 is twisted clockwise. One of skill in the art would readily be able to modify the adaptor receiver 700 to allow the adaptor 100 to be twisted counterclockwise by changing the orientation of the seat 703, tangs 705, and slots 709. The thickness of the adaptor seat 703 and the axial size of the gap 105 may be substantially similar such that there is friction between the adaptor and the adaptor receiver 700 when the adaptor 100 rotates relative to the adaptor receiver 700 to provide a tight fit between the adaptor 100 and the adaptor receiver 700.

The tangs 705 have stops 707 that extend below the recessed plane 701. The stops 707 may advantageously be edges of the tangs 705 that are bent to receive the stops 401 of the tabs 101, or the stops 707 may be another structure. As the adaptor 100 is twisted or rotated within the adaptor receiver 700, the stops 401 of the tabs 101 meet and are stopped by the stops 707 of the tangs 705. The stops 707 extend away from the adaptor seat 703 in such a way as to interfere with the travel of the tabs 101, and hence the adaptor 100, within the adaptor receiver 700. As a result, the adaptor 100 has only one orientation with respect to the adaptor receiver 700 when the stops 401 and 707 meet. As shown in the figures, the entire tang 705 extends away from, e.g., below, the adaptor seat 703. Alternatively, only a part of the tang 705, including the stop 707, extends away from the adaptor seat.

The flange 109 of the adaptor has a linear surface 605 opposing a partially circular surface. The adaptor receiver 700 also has a linear surface 711 opposing a partially circular surface. If keyed tabs 101 and slots 709 are not utilized, e.g., for sake of simplicity of forming the adaptor 100 and adaptor receiver 700, the flange 109 may be utilized to line up the adaptor 100 to the adaptor receiver 700 prior to inserting the adaptor 100 into the adaptor receiver 700. For example, there are two possible orientations in which the adaptor 100 may be inserted into the adaptor receiver 700 when the two devices have symmetrical openings. In one orientation, one end of the linear surface 605 of the flange 109 points to the linear surface 711 of the adaptor receiver 700 prior to insertion, and the other end of the linear surface 605 of the flange 109 points to the linear surface 711 of the adaptor receiver 700 after insertion. In the other orientation, the ends of the linear surface 605 of the flange 109 point away from the linear surface 711 of the adaptor receiver 700 at all times. One of these orientations may chosen for manufacturing. The flange 109 may be oriented with respect to the adaptor 100 in other ways to make keying of the insertion of the adaptor 100 into the adaptor receiver 700 easier.

Figure 8:
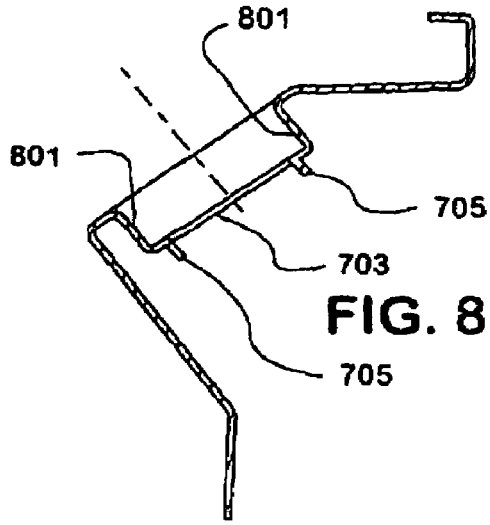
FIG. 8 is a cross-sectional view of an adaptor receiver for a housing in accordance with the invention.

A cross-sectional view of the adaptor receiver 700 for a housing is shown in FIG. 8. A wall 801 in the adaptor receiver 700 is arranged and constructed to receive the seal 501 when it is disposed on the seal seat 107. Thus, the seal 501 prevents leakage between the adaptor receiver 700 and the adaptor 100.

Figure 9:
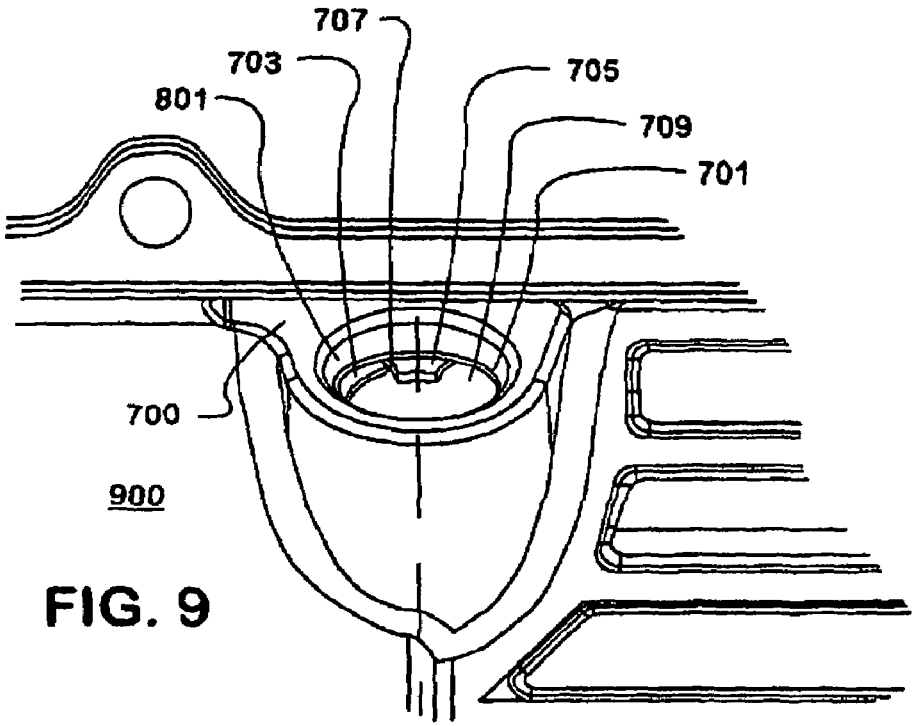
FIG. 9 is a perspective view of a housing having an adaptor receiver in accordance with the invention.

A perspective view of a housing 900 having an adaptor receiver 700 is shown in FIG. 9. In the example of FIG. 9, the housing 900 is a valve cover, such as may be utilized in an internal combustion engine. A seal 501 is disposed on the seal seat 107 of the adaptor 100. The tabs 101 of the adaptor 100 are inserted into the slots 709 of the adaptor receiver 700. The adaptor 100 is twisted or rotated until the stops 401 of the tabs 101 meet the stops 707 of the tangs of the adaptor receiver 700, thereby preventing further movement of the adaptor within the adaptor receiver 700. At this point, the adaptor 100 is uniquely oriented with respect to the adaptor receiver 700, and hence uniquely oriented with respect to the housing 900.

The adaptor and adaptor receiver may be manufactured from a wide variety of materials, including plastics and metals. The adaptor and adaptor receiver may be made of the same materials or different materials. Although the present invention is described with respect to an adaptor that is part of an oil fill tube and an adaptor receiver that is part of a valve cover for an internal combustion engine, the present invention may be utilized for other fluids, such as coolant, water, or air, and in applications other than internal combustion engines.

The present invention provides a method and apparatus for attaching an adaptor to a valve cover that does not leak and is not expensive to manufacture. The adaptor may be shipped separate from the valve cover, thus is not bulky when shipped. The present invention provides any desirable orientation between the adaptor and the valve cover, which orientation may be unique.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. The combination of an adaptor tube and an adaptor receiver, wherein:

the adaptor receiver comprises a side wall circumferentially bounding an opening and a radially inwardly directed seat at an axially inner end of the side wall, the seat having axial thickness and a partial circumferential extent beginning at a slot in the opening;

the adaptor tube comprises an outside on which is disposed a seal sealing the adaptor tube outside to the side wall of the adaptor receiver;

the adaptor tube further comprises a gap that is radially outwardly open, that has axial thickness bounded on an axially outer side by a circular guide and on an axially inner side by a tab (101), and that is open at a circumferential end of the tab;

the seat fits in the gap;

and at the open circumferential end of the gap, the tab is circumferentially abutting a stop on the receiver that is more axially inward of the opening than the seat.

2. The combination of claim 1 wherein the guide also forms an axially inner side of a channel in the outside of the adaptor tube in which channel the seal is disposed.

3. The combination of claim 2 wherein the seal is an O-ring seal.

4. The combination of claim 1 wherein the outside of the adaptor tube comprises a non-circular flange axially outward of the guide.

5. The combination of claim 1 wherein the adaptor tube comprises a bend that is exterior to the receiver.

6. The combination of claim 1 wherein the adaptor receiver comprises another radially inwardly directed seat at an axially inner end of the side wall and spaced circumferentially of the stop by another slot, the another seat having axial thickness and a partial circumferential extent beginning at the another slot;

the adaptor tube comprises another gap that is radially outwardly open, that has axial thickness bounded on an axially outer side by the circular guide and on an axially inner side by another tab, and that is open at a circumferential end of the another tab;

the another seat fits in the another gap;

and at the open circumferential end of the another gap, the another tab is circumferentially abutting another stop on the receiver that is more axially inward of the opening than the another seat.

7. A method of installing an adaptor tube in an adaptor receiver, wherein the adaptor receiver comprises a side wall circumferentially bounding an opening and a radially inwardly directed seat at an axially inner end of the side wall, the seat having axial thickness and a partial circumferential extent beginning at a slot in the opening; the adaptor tube comprises an outside on which is disposed a seal sealing the adaptor tube outside to the side wall of the adaptor receiver; the adaptor tube further comprises a gap that is radially outwardly open, that has axial thickness bounded on an axially outer side by a circular guide and on an axially inner side by a tab (101), and that is open at a circumferential end of the tab, the method comprising:

disposing the adaptor tube in alignment with the opening, including alignment of the tab with the slot, inserting the adaptor tube into the opening, including inserting the tab into the slot, seating the adaptor on the seat with the thickness of the gap aligned with the thickness of the seat and the seal sealing to the side wall;

and then turning the adaptor tube relative to the receiver to slide the gap onto the seat and continuing to turn the adaptor tube until the tab abuts a stop on the receiver that is more axially inward of the opening than the seat.

* * * * *